US005498226A

United States Patent [19]

Lenkauskas

[11] Patent Number: 5,498,226

[45] Date of Patent: Mar. 12, 1996

[54] TOTALLY IMPLANTED HEARING DEVICE

[76] Inventor: Edmundas Lenkauskas, 2444 Madison Rd. Ste. 1404, Cincinnati, Ohio 45208

[21] Appl. No.: 488,303

[22] Filed: Mar. 5, 1990

[51] Int. Cl.[6] ..... H04R 25/00

[52] U.S. Cl. ..... 600/25

[58] Field of Search ..... 128/420.6; 600/25; 623/10, 11; 381/68.6; 181/135; 607/55–57

[56] References Cited

U.S. PATENT DOCUMENTS

| | | | |
|---|---|---|---|
| 3,594,514 | 7/1971 | Wingrove | 600/25 |
| 4,063,048 | 12/1977 | Kissiah, Jr. | 600/25 |
| 4,729,366 | 3/1988 | Schaefer | 128/420.6 |

*Primary Examiner*—Angela D. Sykes
*Assistant Examiner*—J. Lacyk
*Attorney, Agent, or Firm*—Vytas R. Matas

[57] ABSTRACT

A totally implanted hearing device is located within a dry cavity formed in the mastoid area of the human skull to house and mount the device and associated electronic hardware allowing the bypass of the middle ear's oscicullar chain. The device uses spring prosthesis coupled to sense the vibrations of the tympanic membrane and transmit same to the electronic hardware which senses, amplifies, and which transmits the amplified signal to a transducer which is connected to a piston which vibrates the parilymph fluid of the inner ear to achieve enhanced hearing free of feedback and distortion.

6 Claims, 8 Drawing Sheets

Inner Ear

TOTALLY IMPLANTED HEARING DEVICE

BACKGROUND OF THE INVENTION

1. Field of the Invention

The present invention is drawn to implantable hearing devices in general and more particularly to totally implantable electronic hearing devices which bypass the ossicular chain of the middle ear by connecting the vibrations of the tympanic membrane directly to the parilymph fluid of the inner ear through a self-contained electronic amplification assembly.

2. Description of the Prior Art

Totally implanted electronic hearing devices are known wherein the electronics consisting of the power pack, sensor, amplifier and transducer are located within a hollowed out portion of the skull such as the mastold cavity. These devices use microphones to pick up the sound in the outer ear by way of a tube connected to the microphone from the outer ear. The sound is then amplified and sent to a transducer which is connected to the ossicular chain which in turn transmits this amplified signal to the inner ear through the oval window. An example of such a device is found in U.S. Pat. No. 3,882,285 by Nunley, et al.

Other devices use microphones located Just under the skin behind the outer ear to receive audio signals and transmit them to the middle ear. Examples of such devices are found in U.S. Pat. Nos. 3,346,704 and 3,557,775.

These forementioned devices all transmit their amplified signals to the ossicular chain of the middle ear which in turn activates the inner ear by way of the oval window. The ossicular chain thus adds a mass which must be activated by the amplified signal and thus acts as an energy sink for the amplified signal.

Other devices require disarticulation of the ossicular chain. Thus a more sensitive device was needed which would bypass the normally functioning existing ossicular chain and only add an additional amplified signal of tympanic membrane vibrations directly to the inner ear.

SUMMARY OF THE INVENTION

The present invention solves the problems associated with prior art devices as well as others by providing a totally implantable hearing device which senses the vibrations of the tympanic membrane, amplifies these vibrations and transmits these amplified vibrations directly to the inner ear supplementing the function of an existing ossicular chain.

This is accomplished by forming a cavity in the mastoid area of the human skull and mounting a battery powered transducer, amplifier and vibrator therein. A modified wire spring ossicular prosthesis is used to connect the sensor to the tympanic membrane by coupling the prosthesis to the malleus head at one end and to the sensor at the other end. The sensor converts the sensed vibrations into an electrical signal which is then amplified and this signal is then used to drive the vibrator. The vibrator is mechanically coupled to a formed flexible covering over an artificially created vestibule and window near the semicircular canals of the inner ear. This covering is in communication with the parilymph fluid of the inner ear to thus provide an amplified signal of the tympanic membrane vibrations directly to the inner ear.

Thus it will be seen that one aspect of the present invention is to provide a totally implantable hearing device which will transmit sound vibrations directly to the inner ear.

Another aspect of the present invention is to provide a hearing booster which will supplement the function of an existing ossicular chain.

Yet another aspect is to provide a hearing device which requires less electric energy to drive the transducers while attaining adequate sound perception.

Still yet another aspect of the present invention is to provide a positive and trauma free coupling of tympanic membrane vibrations to the amplifying circuitry of the present device by using a modified ossiculating wire spring prosthesis.

These and other aspects of the present invention will be more fully understood upon due consideration of the following description of the preferred embodiment when considered with the accompanying drawings.

DETAILED DESCRIPTION OF THE PREFERRED EMBODIMENT

Figure 1:
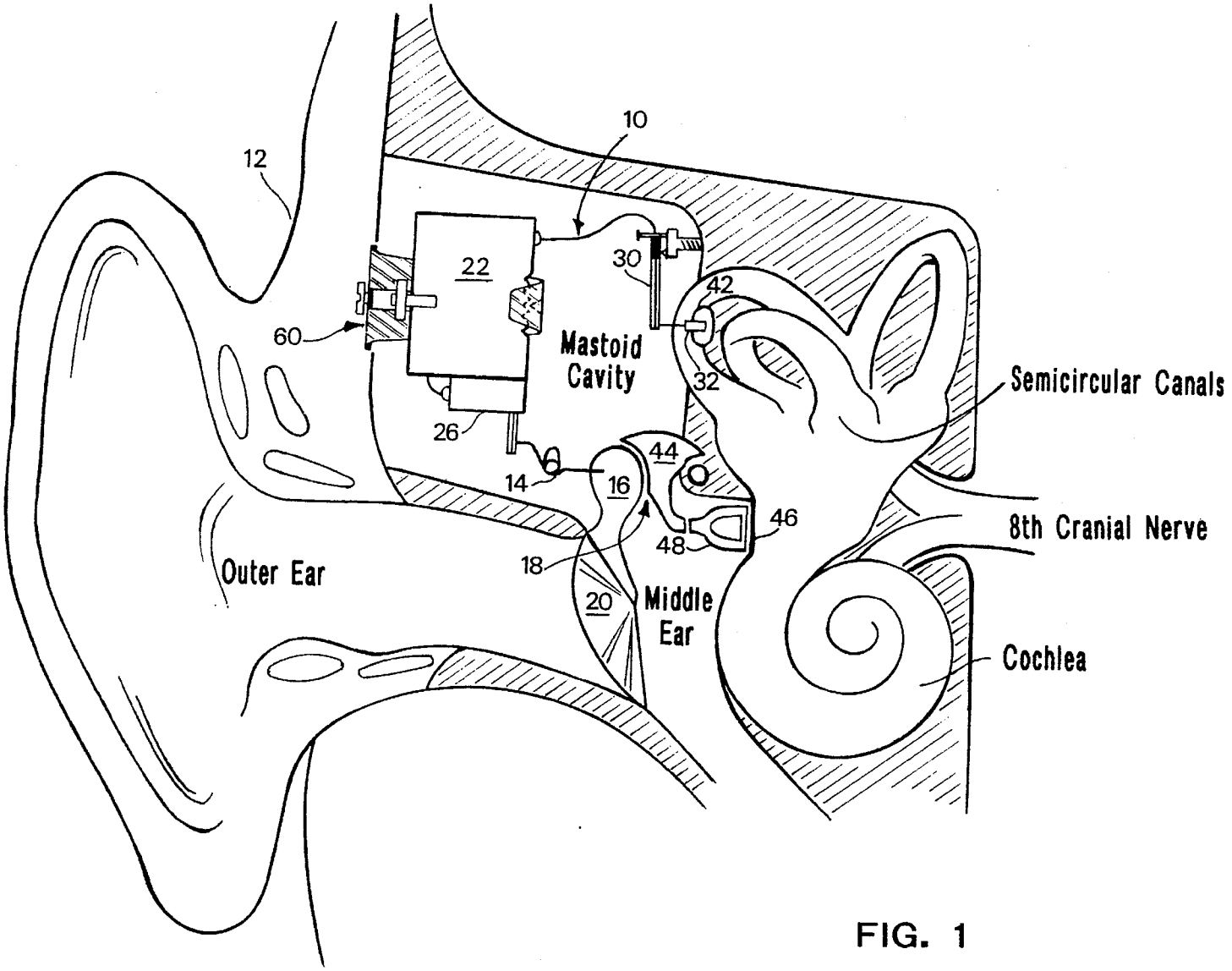
FIG. 1 is a cross sectional view of the ear showing the implanted device of the present invention.

Referring now to the drawings where a preferred embodiment of the present invention is disclosed it will be understood that the disclosure is for purposes of illustration and not for purposes of limiting the invention thereto.

Turning now to FIG. 1 it will be seen that the hearing assembly (10) of the present invention is totally implanted inside a human head (12) by hollowing out a mastoid cavity posterior to the ear canal in a known manner and mounting the assembly (10) therein. The mastoid cavity thus provides a dry secure area for the assembly (10).

The assembly (10) comprises a modified ossicular wire spring prosthesis (14) of the type described in U.S. Pat. No. 4,624,672 and U.S. Pat. No. 4,957,507 mounted to a malleus

(16) of the ossicular chain (18) in a manner described therein, and these references are thus incorporated by reference into the present application.

Thus the prosthesis (14) transmits the vibrations of the tympanic membrane (20), by virtue of the malleus (16) being connected thereto, to the electronic assembly (22) to which the prosthesis (14) is also connected.

Figure 6A:
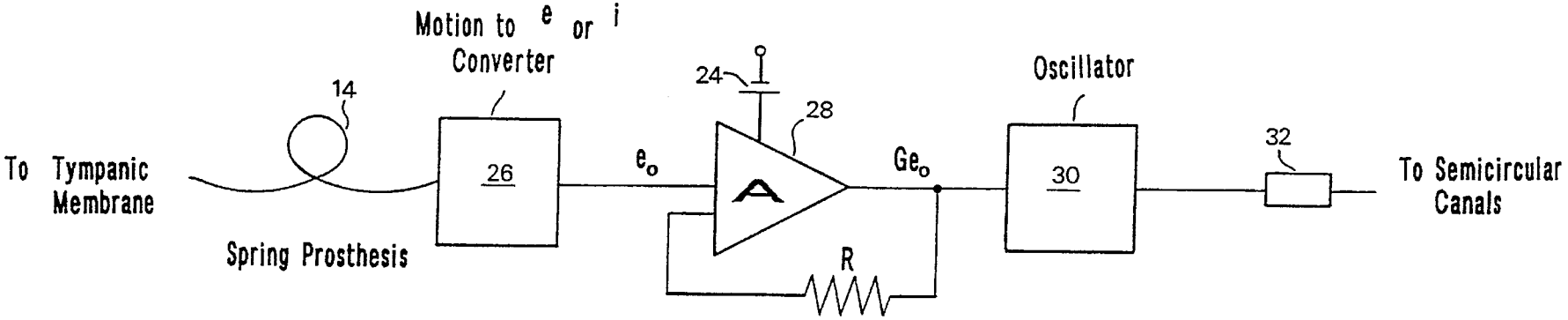
FIG. 6*a* is a functional schematic of the electronic circuitry of the FIG. 1 device.

As may be best seen in FIG. 6a, the electronic assembly (22) comprises a compact dry cell battery (24) which may be either periodically replaced or trancutaneously recharged. A motion to voltage or current converter (26), an amplifier (28), and an oscillator (30) are also provided.

The tympanic membrane (20) vibration as sensed by the prosthesis (14) is transmitted to the sensor (26) by virtue of the mechanical coupling of the prosthesis (14) thereto in a known manner. The sensor (26) establishes an electrical voltage or current signal in response to these vibrations which signal basically tracks the mentioned vibration. Other than the particular converter of the preferred embodiment shown in the FIG. 6*b* schematic other known converters such as electrocet microphones, capacitance sensors, bimorph piezoelectric sensors and even electro-optic sensors may be used.

Regardless of the type of sensor, the output of sensor (26) is connected to the amplifier (28) which has a gain G usually determined by the ratio of feedback resistor to that of the input. Noise filtering and phase compensation may be included into the amplifier (28) circuitry as needed.

The amplified and filtered output signal $Ge_o$ is then electrically connected to the oscillator (30) which has a piston (32) driven in accordance to the variations of the output signal $Ge_o$.

Figure 2A:
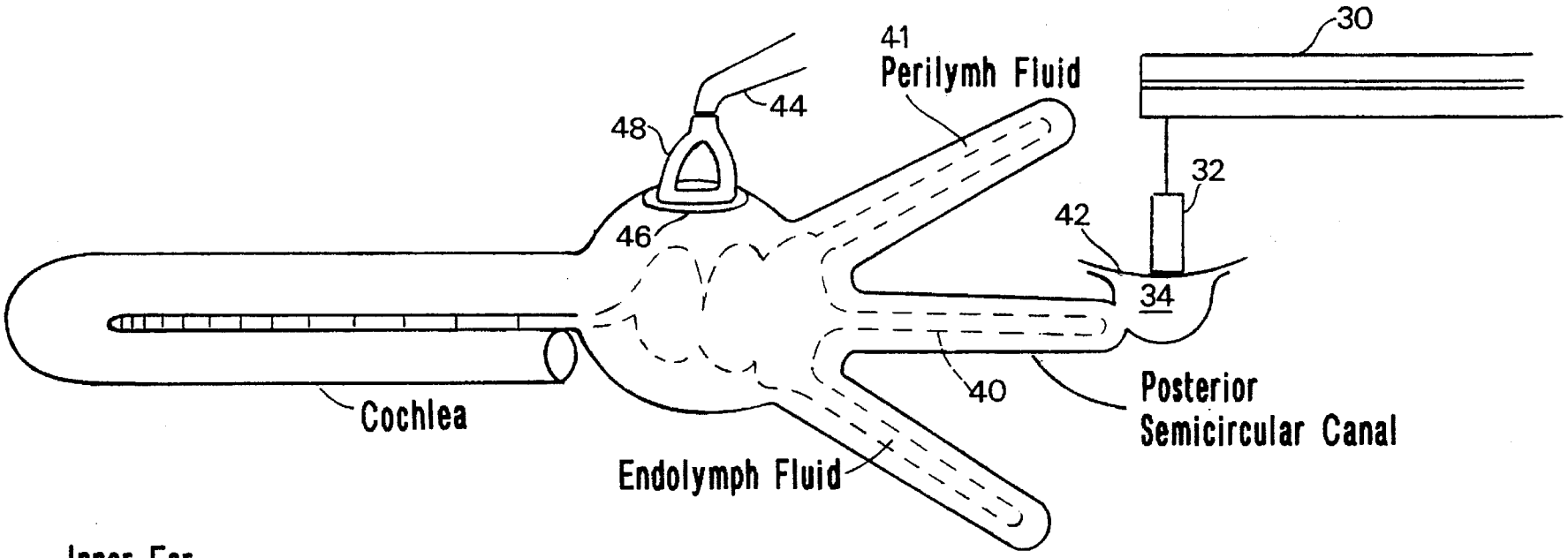
FIG. 2*a* is a schematic of the vibrator mounting in relation to the inner ear of the FIG. 1 device.
Figure 2B:
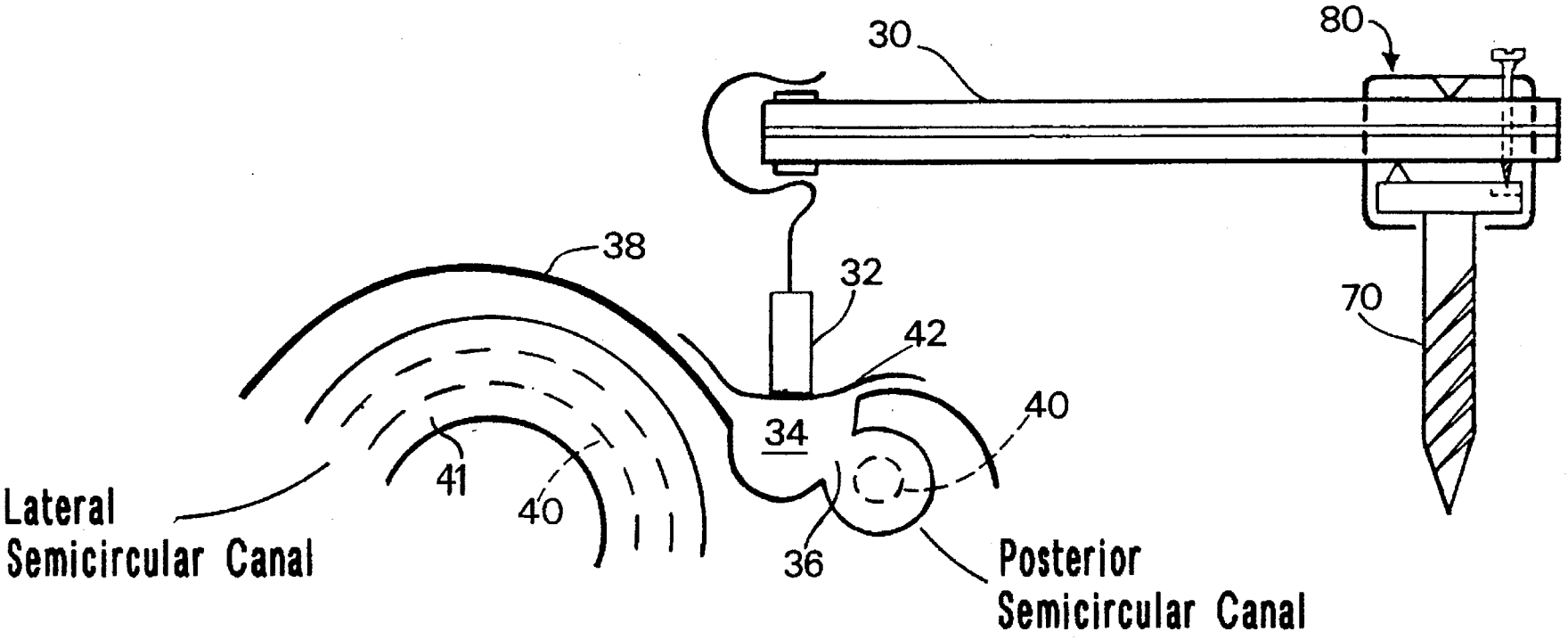
FIG. 2*b* is an enlarged schematic of the vibrator mounting so as to be connected to the parilymph fluid in the posterior semicircular canal of the FIG. 1 device.

The piston (32) is pressure coupled to the parilymph fluid of the inner ear as seen with particular reference to FIG. 2A–2B. This coupling is accomplished as follows.

A mastoid cavity is created in a usual manner. The posterior semicircular canal is then located. Drilling through a bony covering (38) of the canal a vesitbule (34) is artificially created in between the lateral and posterior semicircular canals and is made to communicate with the posterior semicircular canal from there by a window (36) to reach the parilymph fluid (41) without damaging membrane tubing (40) which contains the endolymph fluid. The created vesitbule (34) is then covered with perichondrium (42) or fascie which covers and seals the vestibule (34). The piston (32) is pressed against the perichondrium (42) by the mounting of the oscillator (30) to the mastold wall as will be described later. Any vibration of the piston (32) induced by the oscillator (30) is thus transmitted directly to the parilymph fluid (41) of the inner ear in a manner that bypasses and boosts the normal sound transmission occurring to the inner ear by way of the incus (44) and stapes (48) of the oscicullar chain (18) being connected to the inner ear through the oval window (46).

The electronic assembly (22) is retained in a fastening assembly (60) which may be best understood with particular reference to FIGS. 1 and 3.

Figure 3C:
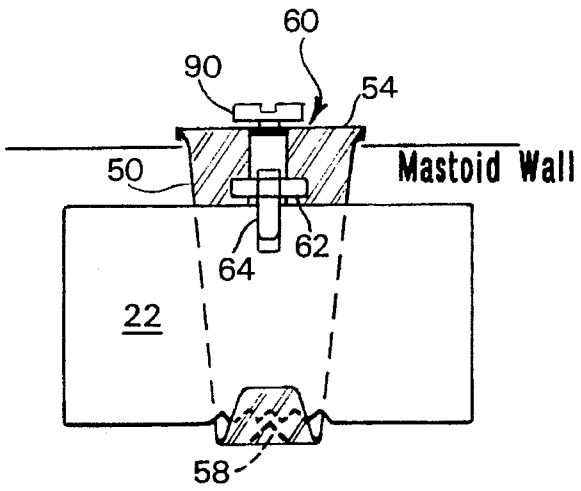
FIG. 3*c* is a front view of the FIG. 3*b* device.
Figure 3D:
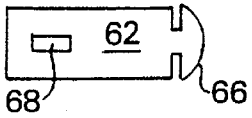
FIG. 3*d* is an expanded view of the locking mechanism of the 3*b* device.
Figure 3B:
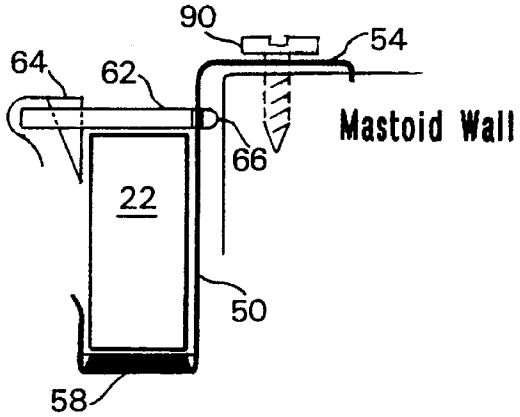
FIG. 3*b* is an end view of the FIG. 3*a* device holding the electronic assembly of FIG. 1.
Figure 3A:
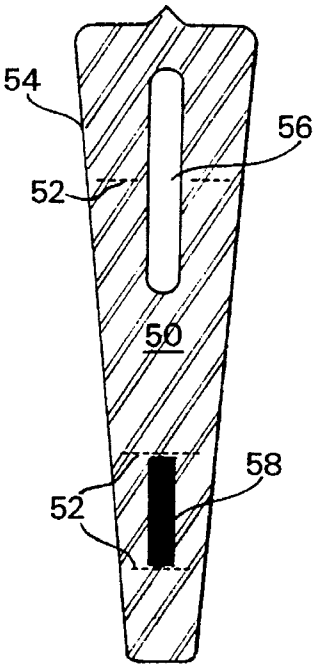
FIG. 3*a* is a plane view of the mounting bracket for the electronic assembly of the FIG. 1 device.

The assembly (60) is made from biocompatible material such as stainless steel and comprises a flat sheet of material (50) as seen in FIG. 3*a* bent around the electronic assembly (22) along the dotted lines (52) in the manner shown in FIGS. 3*b* and 3*c*. The top portion 54 of the plate (50) has a slot opening (56) for retaining a biocompatible screw (90) used to retain the fastening assembly (60) to an area of the human skull behind the ear. The assembly (60) is rotated as needed and then firmly screwed into a wall of the mastold to have a tip (55) of the assembly embed in the mastold wall as seen in FIG. 3*b*.

The assembly (60) retains the electronic assembly (22) to itself by inserting a head (66) of a retainer (62) edgewise into the slot (56) and rotating it flat against the electronic assembly (22). A key (64) is then wedged into a slot (68) to capture the electronic assembly (22) within the fastener assembly (60).

A raised wedge portion (58) is formed laterally along the part of the surface (50) as seen in FIGS. 3*a*, 3*b*, and 3*c* and may be serrated. This wedge (58) pivots assembly (22) and provides for forward and backward fine adjustment of the electronic assembly (22).

Figure 4D:
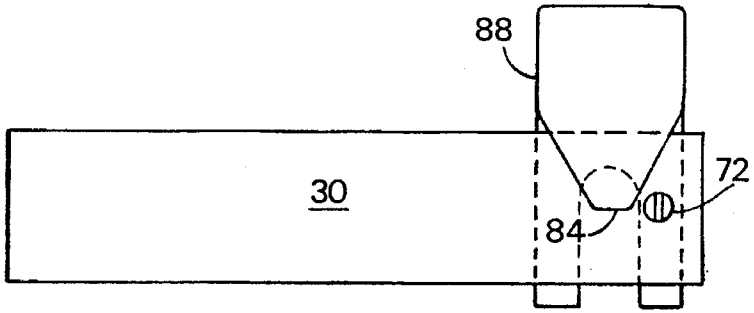
FIG. 4*d* is a top view of the FIG. 4*c* device.
Figure 4C:
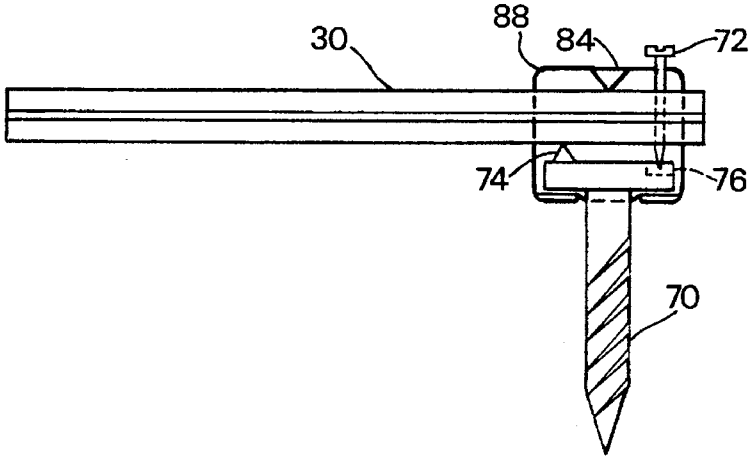
FIG. 4*c* is a side view of the FIG. 4*b* device.
Figure 4B:
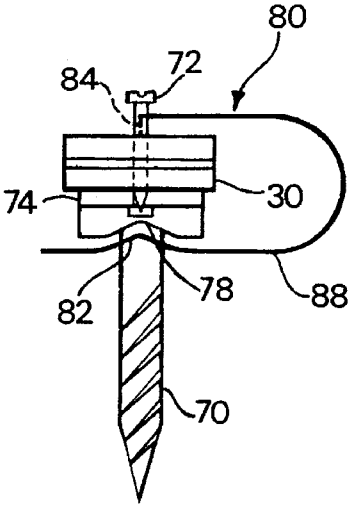
FIG. 4*b* is an end view of the FIG. 4*a* device holding the vibrator.
Figure 4A:
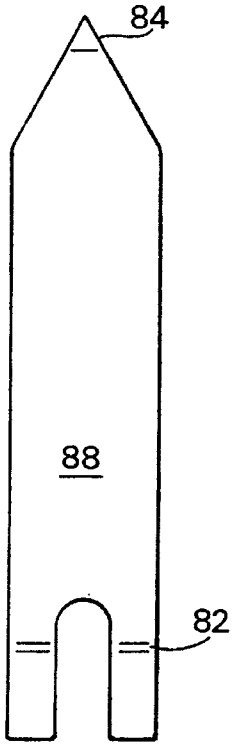
FIG. 4*a* is a top plane view of the vibrator holder of the FIG. 1 device.
Figure 5C:
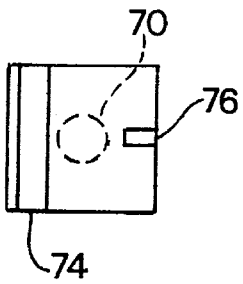
FIG. 5*c* is a top view of the FIG. 5*a* retainer.
Figure 5B:
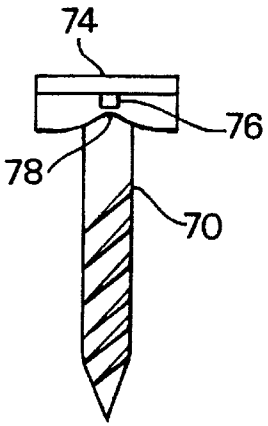
FIG. 5*b* is a front view of the FIG. 5*a* retainer.
Figure 5A:
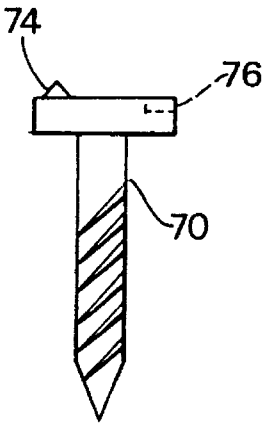
FIG. 5*a* is an expanded side view of the retainer screw used to fasten the FIG. 4*c* device to the edge of the mastold cavity as seen in FIG. 1.

Turning now to FIGS. 1, 4 and 5 it will be seen that the oscillator (30) is retained within a biocompatible spring assembly (80) which is retained within the mastold cavity so as to align the piston (32) to the perichondrium (42) by a biocompatible mounting screw (70) and biocompatible adjustment screw (72). The screw (72) mates with screw (70) and pivots the oscillator 30 around a pivot (74) formed on the edge of the head of the screw (70) by having the tip of the screw (72) push a land surface (76) formed on the head of the screw (70).

The assembly (80) is formed from a flat piece of biocompatible spring material (88) bent as seen in FIG. 4*b* to have a notched portion (82) moved into contact with a compatibly notched portion (78) formed underneath the head of screw (70). A tip (84) of the assembly (80) is retained with an indentation formed on the top surface of the oscillator (30) to hold the oscillator (30) within the assembly (80) while the screw (70) holds the assembly (80) to a wall of the mastoid cavity by being screwed into the medial wall an appropriate distance from the created vestibule and window.

Figure 6B:
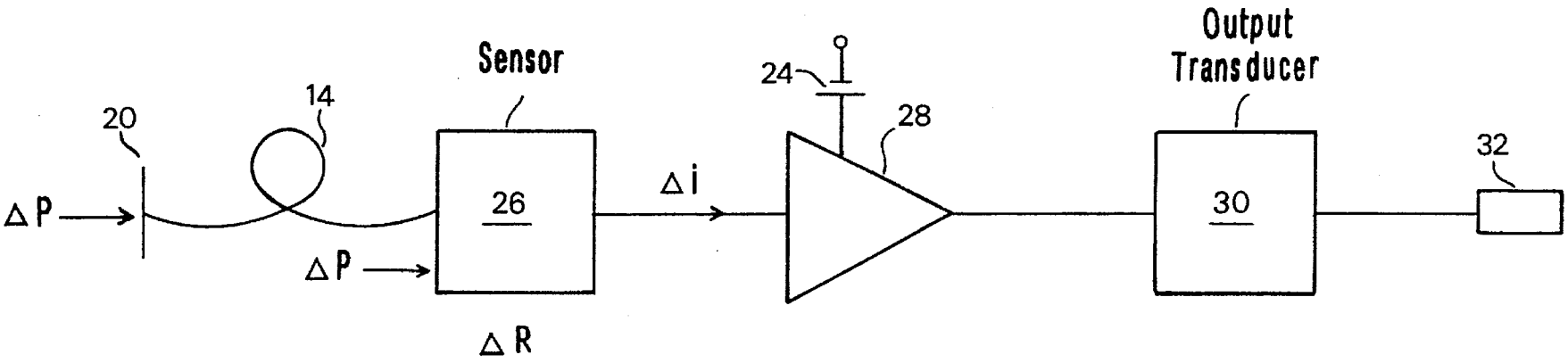
FIG. 6*b* is an enlarged circuit schematic of the sensor of the FIG. 6*a* electronics.

Referring now to FIG. 6*b* is will be seen that the electronic assembly (22) operates as follows.

The spring prosthesis by virtue of its connection to the tympanic membrane (20) is compressed and relaxed in response to the audio pressure waves exerted on the tympanic membrane (20) through the outer ear. These operational features of the ear clearly explained in pages 237 to 251 Section VI *Mechanics of the Auditory System* by Tonndtorf and S. M. Khanna. The applicant has found that approximately a one and one half gram weight will compress the spring prosthesis approximately one milimeter and that normal tympanic membrane (20) vibrations will sufficiently compress the spring prosthesis to transmit membrane pressures to the osicullar chain. These known pressure variation $\Delta P$ are in the present device transmitted by the spring prosthesis to an extremely sensitive piezoelectric crystal sensor which changes resistance $\Delta R$ in response to the tympanic membrane pressure changes $\Delta P$.

The sensor is connected to the battery (24) voltage and hence a current change $\Delta i$ is induced in the sensor in response to the $\Delta R$ according to Ohm's Law $V=iR$. The $\Delta i$ current is amplified by the op amp (28) and the properly amplified $G\Delta i$ is used to drive the oscillator (30).

The oscillator (30) is of the type described in the Gyo, et al article "Stapes Vibration Produced by the Output Transducer of an Implantable Hearing Aid" found on page 1078, Volume 113 of October, 1987 *Arch Otolaryngol Head Neck Surg,* the contents of which are hereby incorporated by reference thereto.

From the foregoing it will be seen that the Applicant has hereby disclosed a totally implantable hearing device which bypasses the ossicular chain and transmits the tympanic vibration directly to the inner ear. Clearly certain details and improvements have been deleted herein for the sake of conciseness and readability but are properly within the scope of the following claims.

I claim:

1. A totally implantable hearing device for bypassing the ossicular chain of the human ear comprising;

means for sensing the vibrations of a tympanic membrane of an ear and establishing a mechanical signal indicative thereof;

electronic means for converting said signal from said sensing means into an electrical signal; and oscillating means driven by the electrical signal of said electronic means for directly vibrating the parilymph fluid of the inner ear wherein said oscillating means is mountable proximate to a vestibule formed between the posterior and lateral semicircular canals of the inner ear to be in communication with the parilymph fluid thereof and being covered with a cover over the vestibule and wherein said oscillating means includes a vibrator having a piston adapted to be mounted against said cover to vibrate said cover in response to said electrical signal of said electronic means.

2. A device as set forth in claim 1, wherein said sensing means includes a wire spring prosthesis adapted to be connected to sense the tympanic membrane vibrations at one end thereof and connected at the other end thereof to said electronic means to transmit the tympanic membrane vibrations to said electronic means.

3. A device as set forth in claim 2, wherein said electronic means includes:

a piezoresistive transducer connected to said wire spring prosthesis adapted to convert the tympanic membrane vibrations transmitted by said prosthesis thereto into electrical signals;

an amplifier connected to said transducer to amplify the electrical signals of said piezoresistive transducer; and said oscillating means including an oscillator responsive to said amplified signal of said amplifier to vibrate said piston against said cover to thereby transmit the tympanic vibrations to the parilymph fluid of the inner ear.

4. A totally implanted hearing aid adapted to be used to transmit tympanic vibrations to the inner ear mounted in an artificially created opening formed between the posterior semicircular canal and the lateral semicircular canal of the inner ear to communicate the parilymph fluid thereto without the danger of puncturing the membrane separating the endolymph fluid comprising:

a flexible covering adapted to be formed over said artificially created opening to seal the parilymph fluid therein while transmitting any vibrations sensed by said flexible covering; and means adapted to be mounted within said artificially created opening proximate to said flexible covering for vibrating said flexible covering in response to the vibration of said tympanic membrane.

5. In a hearing aid as set forth in claim 4, the flexible covering being perichondrium and adapted to be placed in said opening which is formed by a vestibule next to a canal and a window connecting said vestibule to the parilymph fluid of the canal.

6. In a hearing aid as set forth in claim 5, said vibrating means being an oscillator connected to a piston adapted to be pressed against said perichondrium to seal said vestibule thereby.

* * * * *